United States Patent [19]

Masuda et al.

[11] Patent Number: 4,481,256

[45] Date of Patent: Nov. 6, 1984

[54] WADDING MATERIALS

[75] Inventors: Yugoro Masuda, Takatsuki; Toyokazu Nonaka, Osaka; Shigeru Kawase, Nara, all of Japan

[73] Assignee: Kanebo, Ltd., Tokyo, Japan

[21] Appl. No.: 492,547

[22] Filed: May 11, 1983

Related U.S. Application Data

[63] Continuation of Ser. No. 302,274, Sep. 15, 1981, abandoned.

[30] Foreign Application Priority Data

Sep. 18, 1980 [JP] Japan ..... 55-130274

[51] Int. Cl.[3] ..... B32B 5/16; D02G 3/00; D04H 1/04

[52] U.S. Cl. ..... 428/362; 428/288; 428/357; 428/296; 428/370; 428/398

[58] Field of Search ..... 428/357, 359, 361, 362, 428/375, 394, 395, 288, 292, 293, 296, 398, 370

[56] References Cited

U.S. PATENT DOCUMENTS

| | | | |
|---|---|---|---|
| 3,188,790 | 6/1965 | Hebeler | 428/362 X |
| 3,379,001 | 4/1968 | Campbell | 428/359 X |
| 4,040,371 | 8/1977 | Cooper | 428/362 |
| 4,129,675 | 12/1978 | Scott | 428/288 |
| 4,199,642 | 4/1980 | Cooper | 428/288 |
| 4,281,042 | 7/1981 | Pamm | 428/359 |
| 4,304,817 | 12/1981 | Frankosky | 428/362 X |

*Primary Examiner*—Lorraine T. Kendell
*Assistant Examiner*—Beverly Johnson
*Attorney, Agent, or Firm*—Flynn, Thiel, Boutell & Tanis

[57] ABSTRACT

Wadding materials suitable for bedclothes and clothes and having high bulkiness and compressibility, excellent bulkiness recovery, light weight and high warmth retaining ability, which consist of a blend of 80–20% by weight of staple fibers (A) having a monofilament fineness of 3–10 deniers and a curliness of not less than 15% and 20–80% by weight of synthetic polymer staple fibers (B) having a monofilament fineness of 0.7–4 deniers which is smaller than that of the staple fibers (A) and a curliness of less than 15%.

17 Claims, No Drawings

WADDING MATERIALS

BACKGROUND OF THE INVENTION

This application is a continuation of U.S. Ser. No. 302,274 filed Sept. 15, 1981 now abandoned.

The present invention relates to wadding materials having high bulkiness, high compressibility, excellent recovery, light weight and high warmth retaining ability.

As an ideal wadding material, feathers have been known for a long time. Quilts and winter clothes using feathers are bulky and warm even when they contain only a small amount of wadding and further they can be folded in a compact form for storage. A large storage space is not necessary and further the recovery of bulkiness upon reuse is excellent. Therefore, a variety of attempts have been made in order to obtain artificial wadding materials having feather-like properties. For example, it has been attempted to incorporate polyester staple fibers in natural down or to treat polyester fibers with silicone resin but these attempts have not been successful and the delicate structure and other excellent properties of natural down, for example, high compressibility, the capability of being folded and stored compactly, excellent original bulkiness, excellent bulkiness recovery upon reuse after folding and storage, excellent recovery from mechanical force (beat back property) and soft skin touch have not been yet obtained, and satisfactory articles have not been obtained.

SUMMARY OF THE INVENTION

The inventors have continued diligent studies and found wadding materials having unique properties.

An object of the present invention is to provide wadding materials having high bulkiness, moderate resiliency, high drape property, good body fitness, soft touch, light weight and excellent warmth retaining ability.

Another object is to provide wadding materials which can be folded into a compact form upon folding and laying away, are small in the amount of storage space needed, and are excellent in bulkiness recovery upon reuse and can recover their original properties.

The other objects of the invention will be clarified by the following explanation.

The above described objects can be attained by wadding materials composed of a blend of 80–20% by weight of staple fibers (A) having a monofilament fineness of 3–10 deniers and a curliness of not less than 15% and 20–80% by weight of staple fibers (B) composed of synthetic polymers and having a monofilament fineness of 0.7–4 deniers, which is smaller than that of the staple fibers (A) and a curliness of less than 15%.

DESCRIPTION OF THE PREFERRED EMBODIMENTS

The staple fibers (A) to be used in the present invention include various fibers of polyesters, polypropylenes, polyethylenes, nylons, wool and the like and in particular, polyester fibers readily obtain various effects mentioned hereinafter and are preferable for obtaining the wadding materials of the present invention. As the fiber length of the staple fibers (A), 20–120 mm is usually used, 20–100 mm is preferable and 20–80 mm is more preferable. It is not necessary for the fiber length to be uniform but fibers having different lengths may be blended. If the fineness and curliness of the staple fibers (A) are within the moderate range when the staple fibers (B) are blended therewith, the original bulkiness is high and the compressibility is high, and conversely the compression stress and the instant repellency are low, the formed fibrous articles are readily folded and laid away in a compact form, the touch is soft and the body fitness is good. However, when the fineness is too large, the compressibility becomes low, the compression stress and the repellency are too large and it is difficult to fold and lay away the formed fibrous articles in a small space. When the fineness and curliness are too small, the bulkiness is poor, the compression stress becomes too small and the resiliency is lost. From these results, the monofilament fineness of the staple fibers (A) is 3–10 deniers, preferably 4–7 deniers and the curliness is not less than 15%, preferably not less than 18%. The upper limit of the curliness is about 30% in view of the production of crimped fibers.

"Curliness" used herein is expressed by the following formula $$(B-A)/B\times 100(\%)$$

A: The fiber length when a load of 2 mg/denier is applied.

B: The fiber length when a load of 50 mg/denier is applied.

A large number of fibers are sampled from the fibrous assembly of the produced fibrous blend, the measurement is effected with respect to this sample and an average value is determined.

The staple fibers (B) to be used in the present invention include various synthetic fibers of synthetic polymers of polyesters, polypropylenes, polyethylenes, nylons, etc. and among them, polyester fibers can easily provide the effects of the present invention and these fibers are preferable. The fiber length of the staple fibers (B) is about 20–200 mm, preferably 20–150 mm, more preferably 20–120 mm. In this case, bias-cut fibers may be used. The relation of the various effects to the fineness and fiber length of the staple fibers (B) is substantially the same as for the staple fibers (A), but in order to develop the maximum effect in the fibrous assembly wherein the staple fibers (B) are blended with the above described staple fibers (A), the fineness of the staple fibers (B) must be smaller than that of the staple fibers (A) and be within a range of 0.7–4 deniers, preferably 1–3 deniers. The curliness of the staple fibers (B) is less than 15%, preferably less than 10%, and only when staple fibers having such a small curliness which is not usually used, including a curliness of 0, that is having no crimps, are used, can the effect of the present invention be obtained to the maximum limit. When the fibrous articles stored compactly are reused, if the articles are beaten or shaken slightly and a mechanical stimulation or vibration is given, the bulkiness is recovered (this will be referred to as the "beat back property" hereinafter).

The staple fibers (A) and (B) may be not only the fibers consisting of one component alone but also include composite fibers wherein different polymers, the same kind of polymers having different viscosities and the like are conjugate spun in concentric, eccentric or side-by-side form. In addition, the staple fibers (A) and (B) include hollow fibers and porous fibers. If composite hollow fibers are used as the staple fibers (A), crimps can be easily obtained and are fast, and such fibers are light and bulky and are high in the warmth retaining ability, so that such fibers are particularly preferably. In this case, the hollow space percentage is generally about 5-30%.

Furthermore, it is preferable that both the staple fibers (A) and the staple fibers (B) be treated with a lubricating agent, such as an oil, silicone compound, fluorine compound, if necessary, to make the static friction coefficient between fibers less than 0.45, preferably less than 0.20.

In the present invention, it is essential that the particularly defined staple fibers (A) and (B) as described above are blended and in the particularly defined blend range, the compressibility is high, the instant elastic recovery and the compression stress are moderate, laying away is easy and moderate resiliency is obtained, and the use feeling, touch feeling and drape property are excellent. Moreover, surprisingly the blend of the staple fibers (A) and the staple fibers (B) provides synergistic effects which were not expected from the single component case, namely that the original bulkiness and the bulky recovery upon reuse after folding and laying away are excellent, the bulkiness is maintained during use and the warmth retaining ability is excellent. The reason why such synergistic effects are obtained is not clear but it is considered that the entanglement between fibers is reduced due to blending of fibers having a moderately small fineness and a low curliness. For the purpose, 80-20% by weight, preferably 80-30% by weight, more preferably 70-40% by weight of the staple fibers (A) and 20-80% by weight, preferably 20-70% by weight, more preferably 30-60% by weight of the staple fibers (B) are blended. Beyond the above described blend range, the above described excellent effects cannot be obtained.

In the range within which the object of the present invention is attained, staple fibers other than the staple fibers (A) and the staple fibers (B) may be blended in an amount of less than about 30% by weight based on the total fibers. As these staple fibers, mention may be made of synthetic fibers of polyamides, polyesters, polyethylenes, polypropylenes etc., and natural fibers such as wool, etc. Furthermore, fibers in which the fineness and the curliness are not covered by the defined ranges of fineness and curliness of the staple fibers (A) and (B), that is fibers composed of polymers of a low melting point may be blended. Polymers having a low melting point are ones having a melting point which is more than 20° C., preferably more than 30° C. lower than any polymer composing the staple fibers (A) and (B).

The wadding materials consisting of the staple fibers (A) and the staple fibers (B) of the present invention may be blended by a conventional process.

The wadding materials of the present invention may be used not only in web-form but also in a random fibrous mass, for example by disturbing the web arrangement or separating about 1-10 cm of fibrous mass by means of a mechanical, wind or manual force. When the wadding materials are used for bedclothes, the wadding materials of the present invention can be used alone in a single layer or a laminate, and when used in a multi-layer, the wadding may be used as either or both layers of the upper and lower layers or as an intermediate layer.

The wadding materials of the present invention may be used in bedclothes such as a futon (Japanese mattress), clothes used for protection against the cold and warmth retaining ability covered with a proper cloth, various industrial materials needing heat insulation and the like.

The first effect of the wadding materials of the present invention is that they are high in the warmth retaining ability. The wadding materials of the present invention are rich in bulkiness and hold a large amount of air between fibers, so that said materials are warm. Bedclothes and clothes are preferred to be light and warm, and the bulkiness can reduce the amount of wadding filled and make it possible to reduce the weight. In the bedclothes and clothes which are poor in the drape property and do not fit to the body, air warmed by body heat escapes from gaps, but the wadding materials of the present invention fit to the body and retain warmed air, so that said materials are high in the warmth retaining ability.

The second effect is that the wadding materials of the present invention can be folded in a compact form for laying away. Namely, the wadding materials of the present invention are properly low in the compression stress and high in compressibility, so that the volume can be reduced by a relatively small force. When a pressure is removed, if there is an instant elastic recovery, the portion other than a very narrow zone where is pressed by hand instantaneously expands, so that it is impossible to make the entire portion compact. However, the wadding materials of the present invention are low in this instant elastic recovery, so that said materials can be folded and laid away in a small space. In prior wadding materials, ones having a high bulkiness are difficult to compress and ones which are easily compressed are poor in bulkiness and have no resiliency, and it has been difficult to satisfy both the requirements. But the wadding materials of the present invention are bulky and are easily compressed and can satisfy both requirements.

The third effect is as follows. Unless the bulkiness is recovered when the wadding materials folded and laid away in a compact form as described above are reused, the materials have no commercial value. The wadding materials of the present invention are excellent in the elastic recovery property and particularly in the beat back property. The total recovery combining both the recoveries is very good, and a thickness near the original bulkiness is recovered. Prior wadding materials are low in the beat back property and the recovery have relied upon only the elastic recovery, but the wadding is compressed with compressing force when being laid away and further the fibers in the wadding are entangled with one another when the wadding is made into a compact form, so that it is impossible to obtain even the satisfactory elastic recovery and even if the wadding material is bulky at the the original stage, the original bulkiness is no longer obtained upon reuse.

The fourth effect is that the skin touch is soft, the drape property is excellent and the moderate resiliency is provided, so that when the wadding materials are used as bedclothes and clothes, the wear feeling is good.

The wadding materials of the present invention can be produced by means of a conventional carding machine without need for a specific apparatus and are economically and industrially advantageous.

As mentioned above, the present invention can provide qualitatively excellent wadding materials using simple raw materials and a simple manufacturing process, so that the commercial value thereof is very high.

The following examples are given for the purpose of illustration of this invention and are not intended as limitations thereof. "Part" in the following examples means by weight. The following properties were determined as follows.

A sample was compressed to 5 mm by means of an Instron machine and left to stand under the compressed state for 3 minutes, and then the weight was removed and the sample was left to stand under the unloaded state for 3 minutes and then again compressed.

Original bulkiness (A): Thickness (mm) when an preliminary load (1.3 g/cm$^2$ stress) was applied to the sample in the course of the above described first compression.

Compression stress: Stress (g/cm$^2$) immediately after the first compression to 5 mm.

Compressibility: $(A-B)/A \times 100(\%)$ B: Thickness when the stress became 28.3 g/cm$^2$ in the course of the first compression.

Initial compression hardness: Stress (g/cm$^2$) when the sample subjected to the first compression was compressed 20 mm from the thickness when the above described preliminary load (1.3 g/cm$^2$) was applied.

Elastic recovery: $C/A \times 100(\%)$ C: Thickness when the above described preliminary load (1.3 g/cm$^2$) was applied to the sample in the course of the second compression.

A high load of 70 g/cm$^2$ was applied to the sample for 24 hours and then the load was removed and the sample was left to stand for 1 hour to permit the sample to naturally recover bulkiness and then the above described preliminary load (1.3 g/cm$^2$) was applied to said sample to determine the thickness (D). Then the thus treated sample was rotated for 3 minutes with a tumbler drier to apply vibration and thereafter the preliminary load (1.3 g/cm$^2$) was applied to the sample to determine the thickness (E).

| | |
|---|---|
| Beat back amount | E − D (mm) |
| Total recovered bulkiness | E (mm) |
| Total recovery | $\frac{E}{A} \times 100(\%)$. |

Static friction coefficient between fibers was measured by Radar process.

EXAMPLE 1

60 parts of staple fibers (A) consisting of polyester fibers having a fiber length of 76 mm, a curliness of 20–21% as shown in the following Table 1 and a monofilament fineness of 2, 3, 4, 7, 10 and 12 deniers and 40 parts of staple fibers (B) consisting of polypropylene fibers having a fiber length of 38 mm, a curliness of 6.8% and a monofilament fineness of 1 denier were blended and this blend was piled at a rate of 0.4 kg/m$^2$ to prepare a wadding material. This wadding material was covered with a cover cloth. With respect to this article, various properties were evaluated and the obtained results are shown in the following Table 1. Both the fibers were treated with a silicone lubricating agent to make the static friction coefficient between fibers 0.16.

TABLE 1

| Sample No. | Staple fibers (A) Fineness (denier) | Staple fibers (A) Curliness (%) | Compressibility (%) | Compression stress (g/cm$^2$) | Initial compression hardness (g/cm$^2$) | Original bulkiness (mm) |
|---|---|---|---|---|---|---|
| 1-1 (comparative) | 2 | 21.2 | 87 | 24.0 | 5.9 | 43.8 |
| 1-2 (present invention) | 3 | 20.5 | 86 | 29.2 | 6.0 | 47.5 |
| 1-3 (present invention) | 4 | 20.8 | 85 | 31.5 | 6.1 | 49.3 |
| 1-4 (present invention) | 7 | 21.3 | 83 | 39.7 | 6.6 | 52.7 |
| 1-5 (present invention) | 10 | 20.7 | 79 | 47.3 | 7.3 | 52.8 |
| 1-6 (comparative) | 12 | 20.5 | 71 | 63.4 | 9.4 | 53.1 |

From the results in Table 1, it can be seen that when the monofilament fineness of the staple fibers (A) is within the particularly defined range, the original bulkiness is satisfactory, the compressibility and the compression stress are moderate and the samples can be folded and laid away in a compact form. Since the compression stress is not too small, the samples have resiliency when in use, the initial compression hardness is low, and the skin touch is soft.

EXAMPLE 2

The same procedure as described in Example 1 was carried out except that the monofilament fineness of the staple fibers (A) was made 7 deniers without varying the fineness and the curliness was 11.2, 15.8, 18.7, 21.3 and 25.9%. The obtained results are shown in the following Table 2.

TABLE 2

| Sample No. | Staple fibers (A) Curliness (%) | Original bulkiness (mm) | Compression stress (g/cm$^2$) | Initial compression hardness (g/cm$^2$) |
|---|---|---|---|---|
| 2-1 (comparative) | 11.2 | 44.8 | 24.4 | 6.0 |
| 2-1 (present invention) | 15.8 | 47.7 | 29.8 | 6.1 |
| 2-3 (present invention) | 18.7 | 48.5 | 34.3 | 6.3 |
| 2-4 (present invention) | 21.3 | 52.7 | 39.7 | 6.6 |
| 2-5 (present invention) | 26.9 | 51.9 | 43.3 | 7.0 |

From the above described results, it can be seen that if the curliness of the staple fibers (A) is not less than 15%, the original bulkiness is excellent, the compression stress is moderate and the samples can be folded and laid away in a compact form, and the resiliency is not too low, the initial compression hardness is relatively low and the touch is soft.

EXAMPLE 3

40 parts of polyester staple fibers (A) having a monofilament fineness of 5 deniers, a curliness of 22.8% and a fiber length of 60 mm and 60 parts of polyester staple fibers (B) having a fiber length of 30 mm, a curliness of about 8% and a fineness as shown in the following Table 3 were blended to prepare wadding materials and these materials were covered with cover clothes of polyester woven fabric. With respect to these articles, various properties were determined to obtain the results as shown in Table 3.

Both the staple fibers were treated with a silicone lubricating agent to make the static friction coefficient between fibers 0.18.

TABLE 3

| Sample No. | Staple fibers (B) Fineness (denier) | Staple fibers (B) Curliness (%) | Original bulkiness (mm) | Compression stress (%) | Initial compression hardness (g/cm²) |
|---|---|---|---|---|---|
| 3-1 (comparative) | 0.5 | 8.3 | 42.0 | 16.4 | 5.6 |
| 3-2 (present invention) | 1 | 7.5 | 51.3 | 33.3 | 6.0 |
| 3-3 (present invention) | 3 | 7.3 | 54.2 | 37.1 | 6.6 |
| 3-4 (present invention) | 4 | 7.6 | 55.1 | 39.6 | 6.9 |
| 3-5 (comparative) | 5 | 7.9 | 55.7 | 46.6 | 7.7 |

From the above described results, it can be seen that when the fineness of the staple fibers (B) is within the particularly defined range, the original bulkiness is excellent, the compression stress is moderate, the samples can be folded and laid away in a compact form and the samples have moderate resiliency and soft touch.

EXAMPLE 4

The same procedure as described in Example 3 was carried out except that the monofilament fineness of the staple fibers (B) was changed to 2 deniers without varying the fineness and the curliness was varied as shown in the following Table 4. The obtained results are shown in Table 4.

TABLE 4

| Sample No. | Staple fibers (B) Curliness (%) | Original bulkiness (mm) | Beat back amount (mm) |
|---|---|---|---|
| 4-1 (present invention) | 0.2 | 51.5 | 24.1 |
| 4-2 (present invention) | 4.7 | 54.3 | 23.5 |
| 4-3 (present invention) | 6.8 | 53.8 | 21.8 |
| 4-4 (present invention) | 10.6 | 50.7 | 19.5 |
| 4-5 (present invention) | 14.1 | 49.3 | 16.3 |
| 4-6 (comparative) | 17.9 | 46.2 | 11.7 |

From the above described results, it can be seen that when the curliness of the staple fibers (B) is moderately low, the original bulkiness is high and the beat back amount is large when the sample folded in the compact form is reused, and the bulkiness near the original bulkiness can be again obtained.

EXAMPLE 5

Staple fibers (A) consisting of polyester fibers having a fineness of 6 deniers, a fiber length of 50 mm and a curliness of 21.5% and staple fibers (B) consisting of polyester fibers having a fineness of 1.5 deniers, a fiber length of 48 mm and a curliness of 5.1% were blended in the ratios shown in the following Table 5 and the blends were piled at a rate of 0.4 kg/m² to prepare wadding materials. These materials were covered with cover cloths of polyester woven fabrics and various properties were determined with respect to these samples, and the obtained results are shown in Table 5. Both the fibers were treated with a silicone lubricating agent to make the static friction coefficient between fibers 0.18.

TABLE 5

| Sample No. | Blend ratio Staple fibers (A)/Staple fibers (B) | Original bulkiness (mm) | Initial compression hardness (g/cm²) | Compression stress (g/cm²) | Compressibility (%) | Elastic recovery (%) | Beat back amount (mm) | Total recovered bulkiness (mm) | Total recovery (%) |
|---|---|---|---|---|---|---|---|---|---|
| 5-1 (comparative) | 100/0 | 46.8 | 7.7 | 50.3 | 72 | 75 | 9.7 | 40.7 | 87 |
| 5-2 (comparative) | 90/10 | 48.0 | 7.1 | 45.4 | 77 | 72 | 13.2 | 43.2 | 90 |
| 5-3 (present invention) | 80/20 | 50.1 | 6.9 | 42.8 | 79 | 70 | 16.4 | 47.1 | 94 |
| 5-4 (present invention) | 70/30 | 51.3 | 6.7 | 40.4 | 82 | 69 | 19.2 | 49.4 | 96 |
| 5-5 (present invention) | 50/50 | 55.1 | 6.3 | 37.1 | 86 | 67 | 23.8 | 54.6 | 99 |
| 5-6 (present invention) | 30/70 | 50.5 | 6.0 | 32.1 | 86 | 65 | 22.0 | 49.5 | 98 |
| 5-7 (present invention) | 20/80 | 49.3 | 5.9 | 29.9 | 87 | 63 | 23.0 | 47.3 | 96 |
| 5-8 (comparative) | 10/90 | 47.1 | 5.9 | 24.3 | 87 | 62 | 23.6 | 44.3 | 94 |
| 5-9 (comparative) | 0/100 | 44.5 | 5.7 | 21.9 | 88 | 60 | 25.5 | 40.5 | 91 |

From the above described results, it can be seen that when the blend ratio of the staple fibers (A) to the staple fibers (B) is in the proper range, the original bulkiness is high, the compressibility is satisfactorily high, the compression stress is moderately low (not so low that the resiliency is lost) and the instant elastic recovery is relatively low, so that the samples can be laid away in a compact form, and upon reuse, the beat back property is excellent, so that the original bulkiness can be recovered. In addition, the synergistic effect of the blend of both the fibers can be found in the original bulkiness, the total recovered bulkiness and the total recovery.

From the initial compression hardness results it has been found that the higher the soft touch and the higher the blend ratio of the staple fibers (B), the more excellent the drape property is and the better the fitness to the body is.

EXAMPLE 6

Staple fibers (A) consisting of composite hollow fibers obtained by conjugate-spinning polyethylene terephthalate having a relative viscosity ($\eta$rel) of 1.37 and polyethylene terephthalate having a relative viscosity ($\eta$rel) of 1.25 in a ratio of 1:1 in a side-by-side arrangement and having a hollow ratio of 15.7%, a fineness of 6 deniers, a curliness of 22.3% and a fiber length of 65 mm and polyester staple fibers (B) having a fineness of 1.3 deniers, a curliness of 7.0% and a fiber length of 38 mm were blended in a ratio of A/B of 60/40 (parts by weight) to prepare a wadding material. The obtained wadding material was covered with a cover cloth of polyester woven fabric and various properties were determined with respect to this sample. The original bulkiness was 55.2 mm, the initial compression hardness was 6.4 g/cm$^2$, the compression stress was 39.5 g/cm$^2$, the compressibility was 83%, the elastic recovery was 69%, the beat back amount was 22.3 mm, the total recovered bulkiness was 54.6 mm and the total recovery was 99%.

What is claimed is:

1. A wadding material having high bulkiness, high compressibility, excellent recovery of bulkiness following compression, light weight and high warmth-retaining ability consisting essentially of a blend of (1) 80% to 20% by weight of staple fibers (A) having a monofilament fineness in the range of from 4 to 10 deniers and having a curliness of from not less than 15% up to about 30%; (2) 20% to 80% by weight of staple fibers (B) made of a synthetic polymer and having a monofilament fineness in the range of from 0.7 to 4 deniers and lower than the fineness of said staple fibers (A), said staple fibers (B) having a curliness of less than 15%, in which the curliness of said staple fibers (A) and (B) is equal to $(B-A)/B\times 100\%$, wherein A is the fiber length under a load of 2 mg/denier and B is the fiber length under a load of 50 mg/denier.

2. A wadding material as claimed in claim 1, wherein the monofilament fineness of said staple fibers (A) is 4–7 deniers, and the curliness of said staple fibers (A) is not less than 18%.

3. A wadding material as claimed in claim 1 or claim 2, wherein the fiber length of said staple fibers (A) is 20–120 mm.

4. A wadding material as claimed in claim 1, wherein said staple fibers (A) are synthetic fibers of polyamides, polyesters, polyethylene or polypropylene.

5. A wadding material as claimed in claim 1, claim 2 or claim 4, wherein the monofilament fineness of said staple fibers (B) is 1–3 deniers.

6. A wadding material as claimed in claim 1, claim 2 or claim 4, wherein the curliness of said staple fibers (B) is less than 10%.

7. A wadding material as claimed in claim 1, claim 2 or claim 4, wherein the fiber length of said staple fibers (B) is 20–200 mm.

8. A wadding material as claimed in claim 1, claim 2 or claim 4, wherein said staple fibers (B) are synthetic fibers of polyamides, polyesters, polyethylene or polypropylene.

9. A wadding material as claimed in claim 1, consisting essentially of a blend of 80–30% by weight of said staple fibers (A) and 20–70% by weight of said staple fibers (B).

10. A wadding material as claimed in claim 1, wherein one or both of said staple fibers (A) and said staple fibers (B) are polyester fibers.

11. A wadding material as claimed in claim 1, wherein one or both of said staple fibers (A) and said staple fibers (B) has a static friction coefficient between fibers of less than 0.20.

12. A wadding material according to claim 1, wherein said staple fibers (A) are composite hollow fibers having a hollow space percentage of 5 to 30%.

13. A wadding material as claimed in claim 1, wherein the fiber lengths of said staple fibers (A) are in the range of 50 to 76 mm, and the fiber lengths of said staple fibers (B) are in the range of 30 to 48 mm.

14. A wadding material as claimed in claim 1, consisting of 70–30% by weight of said staple fibers (A) and 30–70% by weight of said staple fibers (B).

15. A wadding material as claimed in claim 1, wherein the curliness of said staple fibers (B) is in the range of 4.7% to 6.8%.

16. A wadding material having high bulkiness, high compressibility, excellent recovery of bulkiness following compression, light weight and high warmth-retaining ability consisting of a blend of (1) from 70% to 40% by weight of polyester staple fibers (A) having a monofilament fineness in the range of 4 to 7 deniers and a curliness of from not less than 18% up to 30%; and (2) from 30% to 60% by weight of polyester staple fibers (B) having a monofilament fineness in the range of from 1 to 3 deniers and having a curliness of less than 10%, in which curliness (%) is equal to $(B-A)/B\times 100$, wherein A is the fiber length under a load of 2 mg/denier and B is the fiber length under a load of 50 mg/denier.

17. A wadding material having high bulkiness, high compressibility, light weight and high warmth-retaining ability consisting of a blend of (1) from 70% to 30% by weight of staple fibers (A) selected from polyamides, polyesters, polyethylene and polypropylene, said staple fibers (A) having a monofilament fineness in the range of 4 to 7 deniers, a curliness of from 15.8% to 26.9%, and a fiber length in the range of 50 to 76 mm; and (2) from 30% to 70% by weight of staple fibers (B) selected from polyamides, polyesters, polyethylene and polypropylene, said staple fibers (B) having a monofilament fineness in the range of 1 to 3 deniers, a curliness of from 0.2% to 14.1%, and a fiber length in the range of 30 to 48 mm, in which curliness (%) is equal to $(B-A)/B\times 100$, wherein A is the fiber length under a load of 2 mg/denier and B is the fiber length under a load of 50 mg/denier.

* * * * *